United States Patent [19]

Kump

[11] Patent Number: 4,457,116

[45] **Date of Patent: * Jul. 3, 1984**

[54] SPACE MODULE

[76] Inventor: Ernest J. Kump, 56 Curzon St., Mayfair, London, W1Y 7PF, England

[ * ] Notice: The portion of the term of this patent subsequent to Jun. 9, 1998 has been disclaimed.

[21] Appl. No.: 272,455

[22] Filed: Jun. 12, 1980

[51] Int. Cl.[3] ..... E04B 1/348; E04F 17/08

[52] U.S. Cl. ..... 52/221

[58] Field of Search ..... 52/79.12, 173, 221, 52/79.1, 79.7, 79.8, 79.9, 220, 221

[56] References Cited

U.S. PATENT DOCUMENTS

| | | | |
|---|---|---|---|
| 2,037,895 | 4/1936 | Gugler | 52/173 |
| 2,665,027 | 1/1954 | Wiesmann | 52/221 |
| 4,372,087 | 2/1983 | Kump | 52/79.12 |

FOREIGN PATENT DOCUMENTS

| | | | |
|---|---|---|---|
| 1539086 | 7/1967 | France | 52/79.12 |
| 2131866 | 11/1972 | France | 52/79.12 |
| WO79/01152 | 12/1979 | PCT Int'l Appl. . | |
| 1362990 | 8/1974 | United Kingdom | 52/79.12 |

*Primary Examiner*—John E. Murtagh

*Attorney, Agent, or Firm*—Flehr, Hohbach, Test, Albritton & Herbert

[57] ABSTRACT

A space module (22) is disclosed herein and includes in combination a single inlet connection (62) for a plurality of utilities, a utility manifold (92, 94, 96, 98) extending from the inlet connection to a plurality of locations in the module, at each of the locations, connections to a plurality of the utilities and modular furniture units (34, 35, 36, 37) having readily releasable coupling (e.g. 101) for connection to the plurality of utilities at each said location.

6 Claims, 8 Drawing Figures

SPACE MODULE

The invention relates to space modules, that is modules having a base and sides and defining therebetween an enclosed space or volume.

The invention provides a space module having in combination a single inlet connection for a plurality of utilities, a utility manifold means extending from the inlet connection to a plurality of locations in the module, at each of the locations, connections to a plurality of the utilities and modular furniture units having readily releasable coupling means for connection to the plurality of utilities at each said location.

Further features and advantages of the invention will be apparent from the following description by way of example, of a preferred embodiment of the invention, the description being read with reference to the accompanying drawings, in which.

Figure 1:
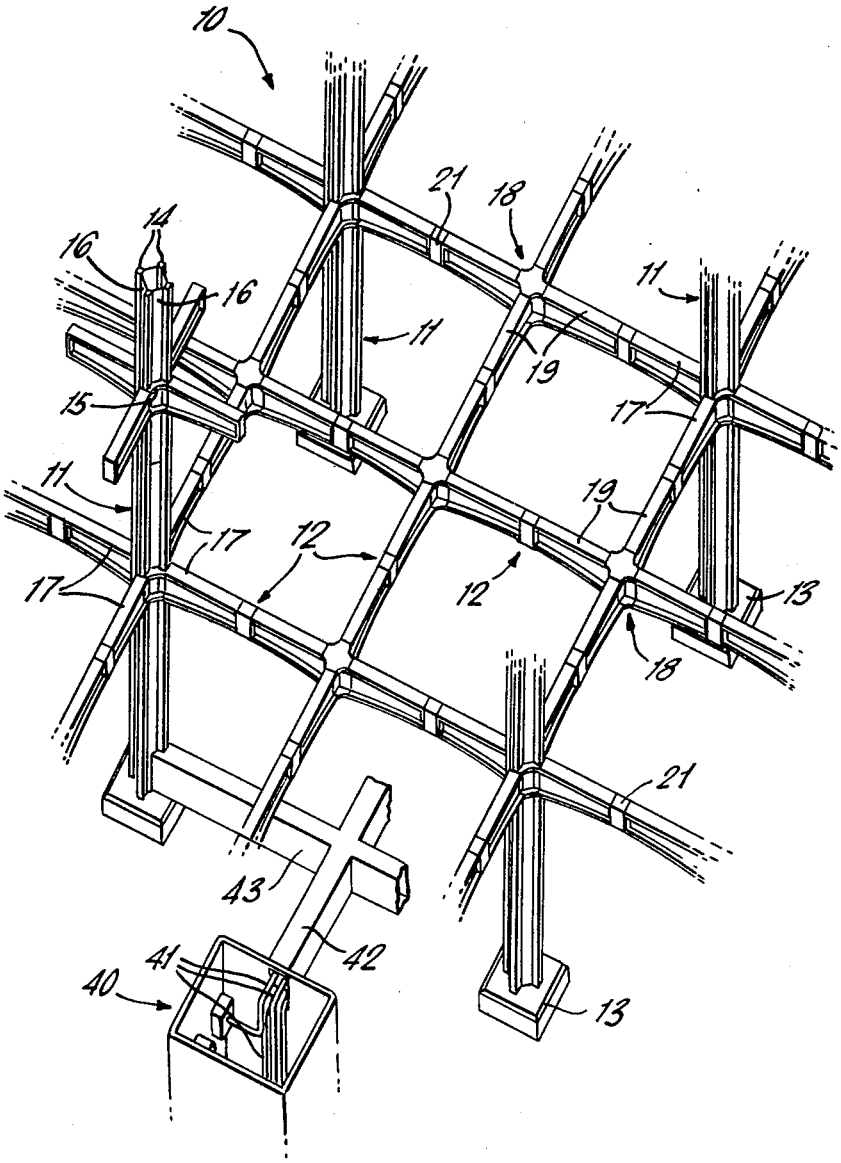
FIG. 1 is a diagrammatic perspective view of part of a support structure of a modular building structure.

In my U.S. Pat. No. 3,712,007, there is described a modular building structure comprising a support structure or space frame which supports a number of space modules and, in my U.S. Pat. No. 3,838,545, the construction of the space modules is described in more detail. Reference is directed to these two patents for a more detailed description of the space frame and space modules and the collar connector and support means by which the space modules are supported on the frame.

Referring now to the drawings, the basic components of the modular building structure are as follows. The space frame 10 comprises a number of spaced vertical columns 11 and horizontal beams 12. Each column 11 is supported by a foundation 13 and comprises a cluster of four vertical structural tubes 14 which are held and maintained in spaced relationship by spaced plates 15. Web plates 16 may interconnect the tubes 14 to provide stiffening of the columns and the wall thickness of tubes 14 and thickness of plates 16 are selected according to the size and weight of the structure to be supported on the space frame. Thus, in multiple storey structures, the lower tubes 14 have thicker walls and the lower parts of columns 11 are provided with web plates 16 of increasing thickness while the upper parts of the columns may dispense with web plates.

At each building level or storey of the space frame, four mutually perpendicular horizontal branch beams 17 are centilevered outwardly from each column 11 to span from one column to the next or to a modular cross beam 18. The branch beams 17 are rigidly attached to the tubes 14, for example by welding. Each modular cross-beam 17 comprises four mutually perpendicular beam portions 19 secured to one another to form a cross with the ends of the cross adapted to be connected to adjacent ends of branch beams 17. The said adjacent ends of branch beams 17 and beam portions 19 joined by a connector member 21 which also serves the purpose of supporting its associated space module on the horizontal beams and levelling the space module, as is described in U.S. Pat. No. 3,712,007.

Each space module 22 is a box-shaped enclosure having floor, roof, walls and openings defining a space. The walls comprise wall compenents 23 curved at one end to abut adjacent wall components to form corners 24 which correspond in shape to rounded corners of floor and roof components 26,27. The floor and roof components have respectively upwardly and downwardly curved edges which co-operate with and are attached to the lower and upper edges of the wall components. Frame components 28 define openings 29 and are similarly attached to the floor and roof components 26,27 and adjacent edges of wall components 23. The floor component 26 provides an outer shell base of the space module and a floor surface is provided within the module by a cruciform member 31 and floor panels 32. The ends of cruciform member 31 abut the lower edges of frames 28 and the edges of the cruciform member are adapted to support the floor panels 32 which fit between the cruciform member and the edge of the floor component 26. As can be seen from FIG. 2, the floor panels 32 may be simply planar panels or may be the base panels of modular furniture units such as kitchen units 34, settee units 35, dining units 36 and bathroom units 37, to be described in more detail below.

As is stated in U.S. Pat. Nos. 3,712,007 and 3,838,545, the building structure is energized by the provision of utilities to the space modules. The utility paths of the illustrated structure will now be described in detail. The utilities which are provided to the modules are water, gas, electricity, telephone and television inputs together with a waste outlet. The utilities are connected to the site on which the building structure is erected through underground conduits, in known manner, and these conduits are connected to a central utility housing 40. Necessary equipment such as transformers, meters, pumps etc. is all located within the housing 40. From the central housing 40, conduits 41 for the utilities are connected to the base of columns 11 through a main feeder duct 42 and branch feeders 43. It will be appreciated that the feeders 42, 43 may be underground in a site in which the bases of columns 11 are underground.

Each column 11 supports a cluster of vertical pipes which carry the utilities up the columns. The vertical pipes include a central pipe 45 which is the soil pipe for waste outlet and four other pipes adjacent the tubes 14, a water riser 46, a gas riser 47, a pipe 48 for electricity supply and a pipe 49 for telephone and television cables. The pipes are maintained in spaced relationship by the plates 15. A further pipe (not shown) may be provided concentric with and surrounding the soil pipe 45, the annular space between the two pipes then serving as a vent pipe.

At the lower end of each column, the pipes 45–49 are connected to the conduits 41 in the branch feeders 43 by suitable junctions (not shown but of known type).

Figure 4:
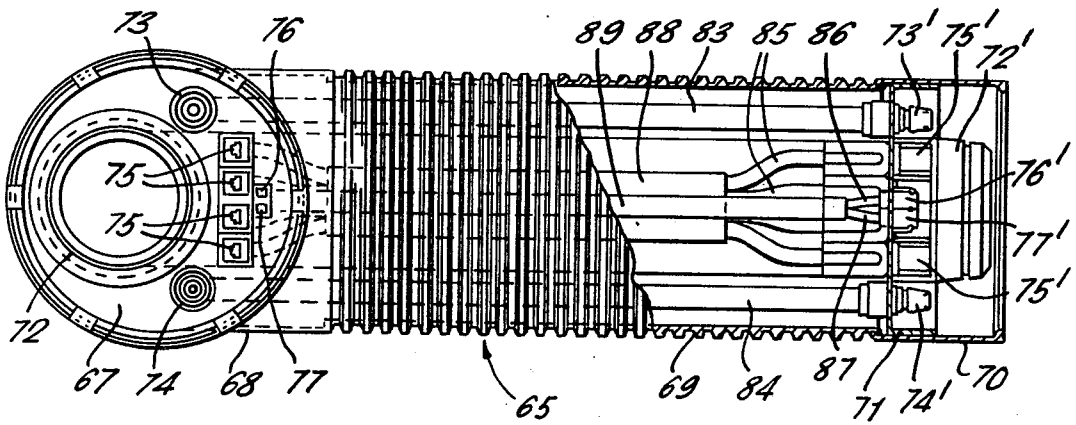
FIG. 4 is an enlarged plan view, partly cut-away, of a coupling member connecting the space module to the support structure.
Figure 5:
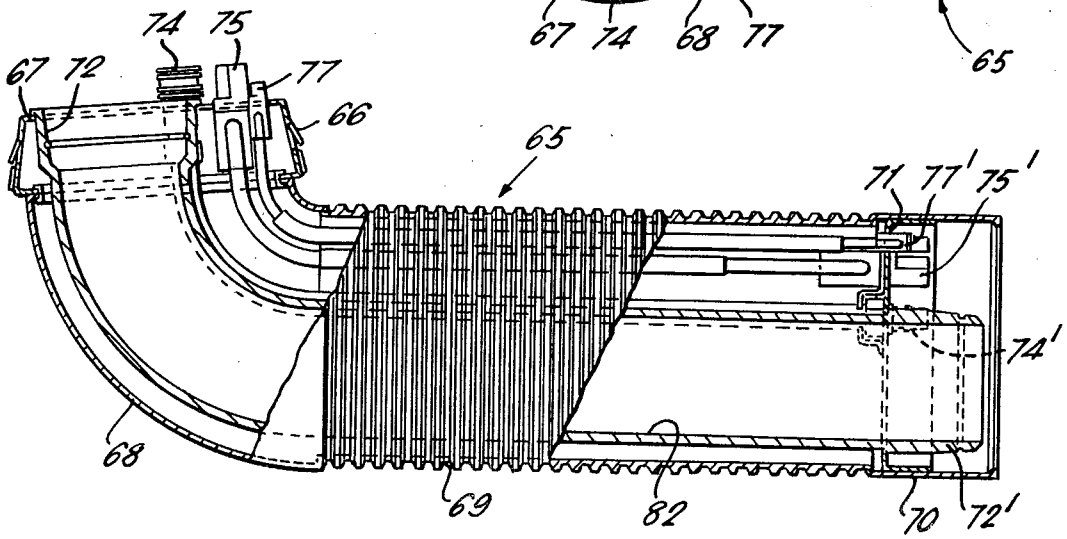
FIG. 5 is an elevation, partly cut away, of the coupling member of FIG. 4.
Figure 8:
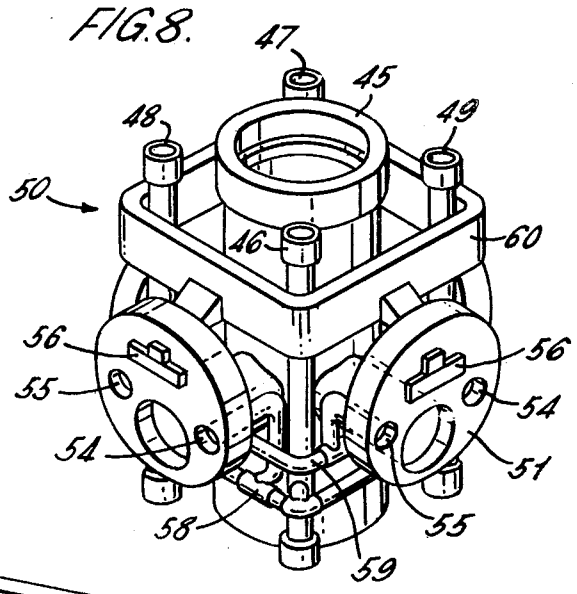
FIG. 8 is an enlarged view of the column manifold of FIG. 3.

At each building level or storey in the structure, a column manifold 50 is provided. The manifold 50 includes sections of the pipes 45–49 extending vertically through the manifold and connections from the pipes 45–49 to a utility outlet plate 51 on each of the four sides of the column (FIG. 8). Each utility outlet plate 51 includes a large soil pipe orifice 53 in its lower part, a water orifice 54 and a gas orifice 55 above and on either side of the soil pipe orifice in the central part of the plate 51 and a group of electrical, telephone and television outlet orifices 56 in the upper central part of the plate 51. The orifices 53–56 are arranged in a predetermined array which corresponds with the array of orifices in the ends of the coupling member shown in FIGS. 4 and 5 and are provided with snap-fit quick couplings as will be described in more detail with reference to FIGS. 4 and 5.

The soil pipe orifices 55 in the plates 51 are provided at the ends of upwardly and outwardly flared portions of pipe 45. The water orifices 54 are provided at the end of branch pipes (not shown) connected to a water distribution pipe 58 which extends around the cluster of pipes 45–49 and is itself connected to the water riser 46. Similarly, the gas orifices 55 are provided at the ends of branch pipes of a gas distribution pipe 59 which extends around the pipe cluster 45–49 parallel to water distribution pipe 58 and is connected to the gas riser 47. The electrical, television, and telephone orifices 56 are connected to the wiring in the pipes 48, 49 by cables running through a peripheral trunking 60 of the manifold 50, the trunking 60 extending around the pipe cluster 45–49 parallel to and above the gas and water distribution pipes.

As is described in U.S. Pat. No. 3,712,007 referred to above and in more detail in my U.S. Pat. No. 3,750,697, the space frame 10 is modular, each vertical column 11 being formed of a number of prefabricated sections, and each section being one storey high. The column manifold 50 may be formed as a separate prefabricated unit which is inserted between adjacent sections of a column or may be integrally formed with a column section in the factory. In the former case, (illustrated in FIG. 3), the sections of pipes 45–49 within the manifold are each provided with snap-fit quick couplings whick co-operate with corresponding couplings in the pipe sections in the columns 11 so that all the pipes are simultaneously coupled and sealed as the manifold 50 is lowered into place on its column.

Figure 2:
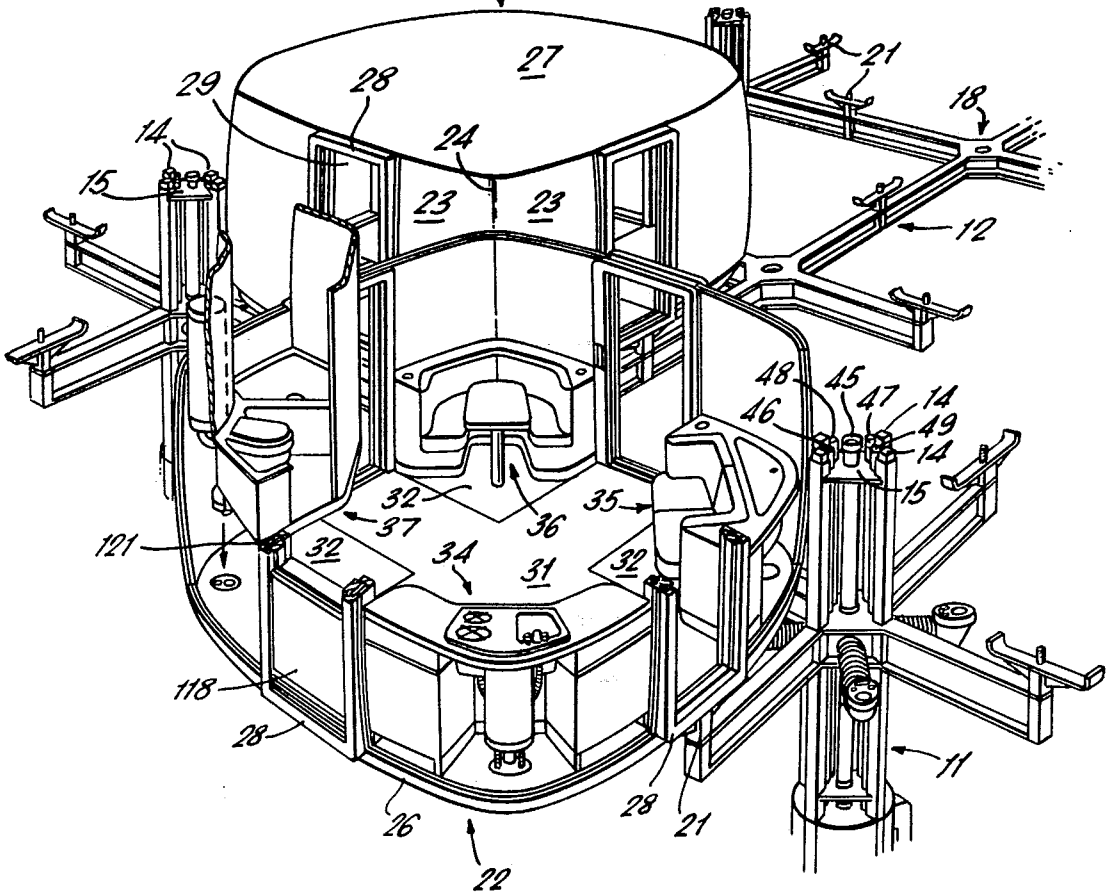
FIG. 2 is a perspective view of part of one level in the structure of FIG. 1 and showing space modules according to the invention forming part of the structure.
Figure 3:
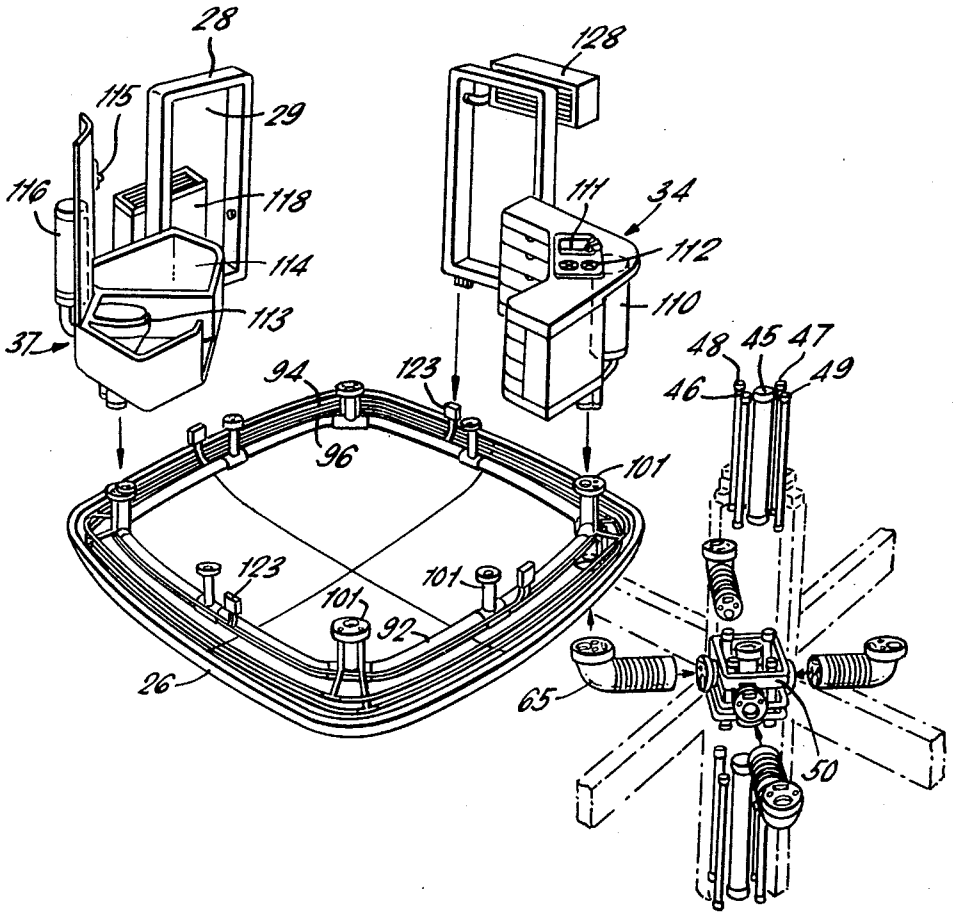
FIG. 3 is an exploded perspective view of one of the space modules and the adjacent support structure.

As can be seen from FIGS. 2 and 3, each space module 22 has one of its corners adjacent to one of the plates 51. Each space module includes at that corner a utility inlet plate 62 (which will be described in more detail below) having an array of utility orifices corresponding to a mirror impage of the plate 51. The column outlet plate 51 and module inlet plate 62 are joined by a coupling member in the form of a multiplex connector 65 which will now be described in more detail with reference to FIGS. 4 and 5.

The multiplex connector 65 has an outer casing comprising a tapered tubular end portion 66 closed off by an end plate 67 and fixed to one end of a curved rigid tubular member 68, a central flexible casing 69 fixed at one end to the free end of member 68 and carrying at its other end a tubular collar 70. A second end plate 71 of the connector is mounted within the collar 70.

Protruding from end plate 67 are the female halves of quick connectors for various utilities which are to be conducted to the module. Considering the lower edge of the coupling member 65 as viewed in FIG. 5 as the bottom of the coupling member and reading from the bottom of the plate 67, the utility connectors are: the soil pipe connector 72 which is a relatively large diameter orifice with an internal O-ring seal; gas 73 and water 74 connectors which are quick-coupling devices of known type arranged one on each side of the plate 67; a row of four electricity connectors 75 which are snap-fit connectors of known type; and telephone 76 and television 77 connectors which are snap-fit connectors of the same type as connectors 75 but smaller.

Protruding from the other end plate 71 of the multiplex connector 65 are corresponding male halves of the quick connectors 72–77 which male halves are referenced by corresponding reference numerals with a prime and which are arranged in the plate 71 in an array which is a mirror image of the array in plate 67. The connectors 72, 72' are joined together by a flexible pipe 82 of the same relatively large diameter as the connectors 72, 72' and the connectors 73, 73' and 74, 74' are joined together by flexible pipes 83, 84 respectively. The connectors 75, 75' are joined by cables 85 and the connectors 76, 76' and 77, 77' by cables 86, 87 respectively, cables 85 being contained in a conduit 88 and cables 86, 87 in a conduit 89.

The plate 51 has its orifices 53–56 arranged in a pattern identical to that of plate 67 and the connectors in the plate 51 are identical to those in plate 67 so that the end 70 of the multiplex connector 65 may be connected to the plate 51 by a simple push-fit action which simultaneously connects all the utilities. Similarly, the inlet plate 62 in the space module corresponds in array and type of couplings to plate 71 so that the end 66 of the connector 65 may be connected to the module inlet plate 62 by a simple push-fit action which simultaneously connects all the utilities into the module.

Figure 7:
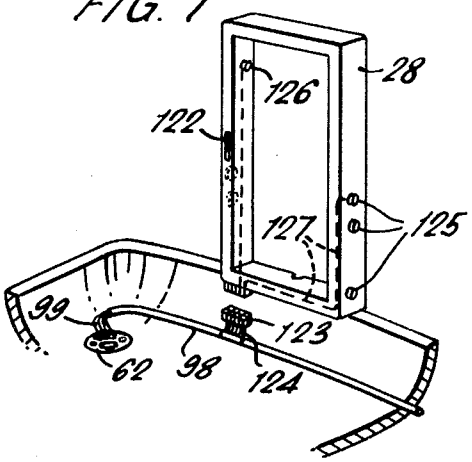
FIG. 7 is a view similar to FIG. 6 but showing the distribution of electrical utilities.
Figure 6:
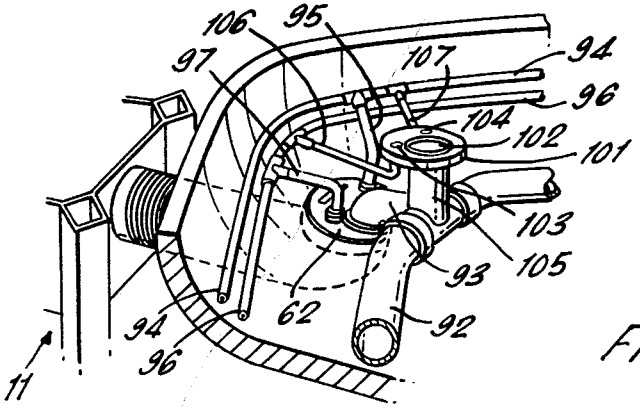
FIG. 6 is an enlarged perspective view of part of one of the space modules, showing the distribution of non-electrical utilitiies.

The distribution of utilities within a space module 22 will not be described with partiuclar reference to FIGS. 3, 6 and 7. Each module contains a module utility manifold in the form of a number of utility conduits which extend around the periphery of the module within the floor component 26 but under the floor surface formed by cruciform 31 and panels 32. The utility conduits are as follows: a soil conduit 92 connected by a pipe 93 to the soil pipe connector in plate 62; a water conduit 94 connected by a pipe 95 to the water connector of plate 62; a gas conduit 96 connected by a pipe 97 to the gas connector of plate 62; and an electricity conduit 98 containing cables 99 connected to the group of electricity connectors of plate 62. The telephone and television connectors of plate 62 are connected to suitable points in the module by cables (not shown). For the sake of clarity, the soil, gas and water conduits are shown in FIG. 6 and the electricity conduit in FIG. 7.

Outlet plates 101 for gas, water and soil are positioned one in each corner of the module 22 and one in the centre of each side. Each plate 101 contains soil 102, gas 103 and water 104 connectors of the same type as in the plates 51 and in the same relative orientation. The connectors 102, 103, 104 are joined to the utility conduits 92, 94, 96 by respective pipes 105, 106, 107 and the length of pipe 105 which supports the plate 101 is selected so that the plate is at floor surface level in the finished module and is accessible through a hole in the corresponding floor panel 32.

Those module furniture units illustrated in FIGS. 2 and 3 which include utilities each have an inlet plate (not shown) in their respective base panels 32. The utility requirements of the units are connected to couplings in said plate of the same type as in plate 62 so that fiting of the modular furniture units into position simultaneously connects the utilities to the units. In the examples shown, the kitches unit 34 includes a gas fired water heater 110 including gas and water inlets, a sink 111 including a water inlet and a soil outlet and a hob 112 including a gas inlet. The bathroom unit 37 includes a lavatory 113 requiring a water inlet and a soil outlet, and a shower comparment 114 with a shower 115 to which hot water is fed from a water heater 116 requiring a gas inlet and a water inlet. Also illustrated in FIGS. 2 and 3 is a space heater 118 which fits within the lower part of one of the frame components 28 and has a gas inlet.

Each frame component 28 includes a raceway 121 in the frame for electrical wiring and equipment. Mounted within the raceway 121 in one of the uprights of the frame component is a set 122 of circuit breakers or fuses for the electricity supply to that frame, the circuit breakers being accessible through a panel in the frame component for repair purposes. The circuit breakers 122 are connected by cables to connectors in the base of the frame which are quick-coupled to electricity outlets 123 in the floor of the module. There are four symmetrically arranged outlets 123, one for each frame component 28, and the outlets 123 are connected to the cables in the electricity conduit 98 by cables 124.

Also mounted in the uprights of the frame component 28 are a number of power outlets 126 being connected to the circuit breakers 122 by wiring 127. One power outlet 126 is arranged in the upper inner surface of one of the uprights of the frame component and this outlet is particularly intended for an air-conditioning unit 128 (see FIG. 3) which fits within the upper part of the frame component. The reamining power outlets are in the lower half of the frame components for receiving electrical connections from the various furniture units.

A major advantage of providing all the electrical wiring in the frame components 28 and the remaining utilities under the floor surface is that the wall components 23 of the space module may, if desired, be made transparent without the need to remove any wiring.

It will be appreciated that the utility distribution arrangement described provides all utilities to each side of each column at each building level through plates 51 and a common set of utilities to each outlet 101 in each space module. Not all these utilities are required at each such outlet and blanking plates (not shown) are provided for sealing the plates 51, 101 which are not required.

The invention is not limited to the embodiment described above and various modifications may be made without departing from the scope of the inventon. For example, in some building structures utilities may not be provided to each column 11 but only to selected columns.

What I claim is:

1. A space module having in combination a single inlet connection for a plurality of utilities, a utility manifold means extending from the inlet connection to a plurality of locations in the module, connecting means at each of the locations for a plurality of the utilities carried in said manifold and modular furniture units having readily releasable coupling means for connection to the plurality of utilities at each said location by said coupling means.

2. A space module as claimed in claim 1 in which the means for connection of the furniture units to at least one of the utilities is a sealing means when that utility is not required for the furniture unit being connected.

3. A space module as claimed in claim 1 in which the space module has a generally polygonal base and the utility manifold means has an outlet location adjacent each corner of the base and adjacent the mid-point of each side of the base.

4. A modular building structure as claimed in any one of claims 1 to 3 in which at least one opening is formed in the module, a frame surrounds the opening and means are provided connecting at least one of the utilities in the module manifold means to control means and outlets in the frame.

5. A space module as claimed in claim 4 in which the utilities include water, gas, electricity, soil outlet, telephone and T.V.

6. A space module as claimed in claim 5 in which the electricity is connected to each frame and the safety overload controls are in the frame.

* * * * *